United States Patent [19]

Freeman et al.

[11] Patent Number: 4,909,011

[45] Date of Patent: Mar. 20, 1990

[54] ELONGATE HOLLOW STRUCTURAL MEMBERS

[76] Inventors: Colin J. Freeman, 80 Beechwood Avenue, Melbourn, Royston, Hertfordshire, United Kingdom, SG8 6BW; Corbett E. Jarvis, 5 The Fairway, Wood End, Bluntisham, Cambridgeshire, United Kingdom, PE17 3LF

[21] Appl. No.: 382,635

[22] PCT Filed: Feb. 9, 1988

[86] PCT No.: PCT/GB88/00075

§ 371 Date: Aug. 8, 1989

§ 102(e) Date: Aug. 8, 1989

[87] PCT Pub. No.: WO88/05850

PCT Pub. Date: Aug. 11, 1988

[30] Foreign Application Priority Data

Feb. 9, 1987 [GB] United Kingdom ..... 8702849

[51] Int. Cl.[4] ..... E04C 3/30

[52] U.S. Cl. ..... 52/731; 52/730; 52/584; 52/464

[58] Field of Search ..... 52/730–732, 52/740, 584, 464

[56] References Cited

U.S. PATENT DOCUMENTS 3,304,679 2/1967 Benkin ..... 52/730 X
3,477,752 11/1969 Richter ..... 52/464
4,068,437 1/1978 Byxbe et al. ..... 52/464
4,184,302 1/1980 Gurewitsch et al. ..... 52/464 X
4,703,603 11/1987 Hills ..... 52/584

*Primary Examiner*—Carl D. Friedman
*Assistant Examiner*—Lan Mai
*Attorney, Agent, or Firm*—Albert L. Jeffers; Anthony Niewyk

[57] ABSTRACT

The disclosure relates to a hollow section elongated structural member comprising three parallel spaced channel section elements (13) with three panels (11) extending between the respective pairs of elements to form a hollow section member. The edges of the panels have edge formations (17) which are received in the channels, each edge formation being shaped to conform to a side wall (15) and adjacent base part (14) of a channel. Clamping members (18) are provided for each channel having a clamping face including a main part (19) flanked by said faces (21) to act in co-operation with the base and side wall of the channel (13) to clamp the respective edge formations of a pair of panels therein and screws (23) are provided for securing the clamping members to the channel to lock the edge parts of the channels in the channels and thereby create a rigid structue between the channels and panels. The arrangement is particulary suitable for lightweight structural members for frameworks to be used in supporting equipment such as lighting or other electrical apparatus, display devices, screens or the like, or for supporting canopies, roofing or walling.

8 Claims, 3 Drawing Sheets

FIG. 1.
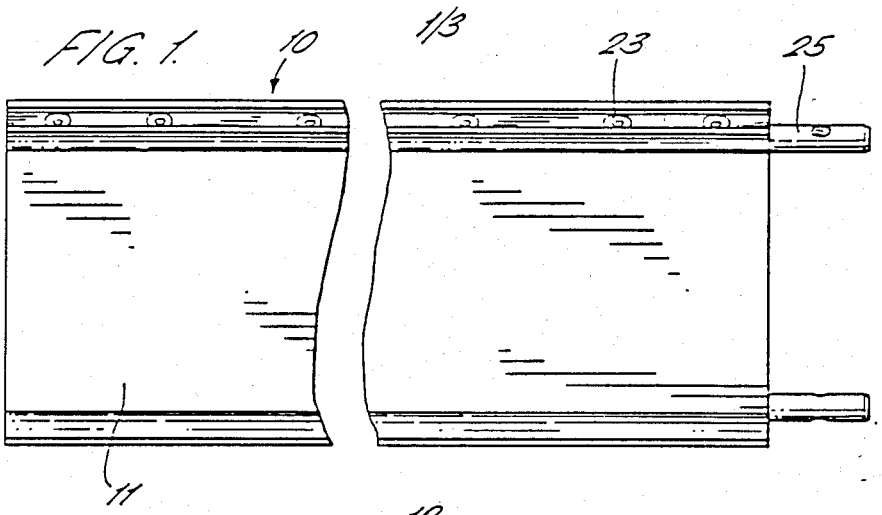
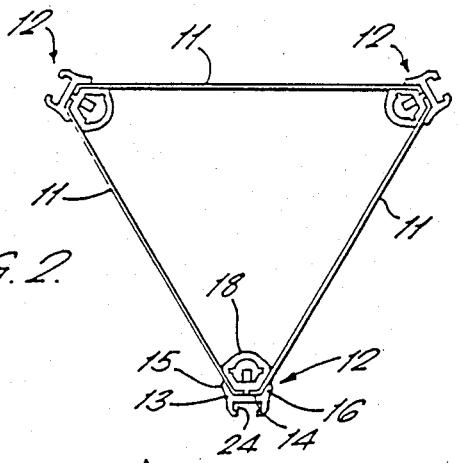
FIG. 2.
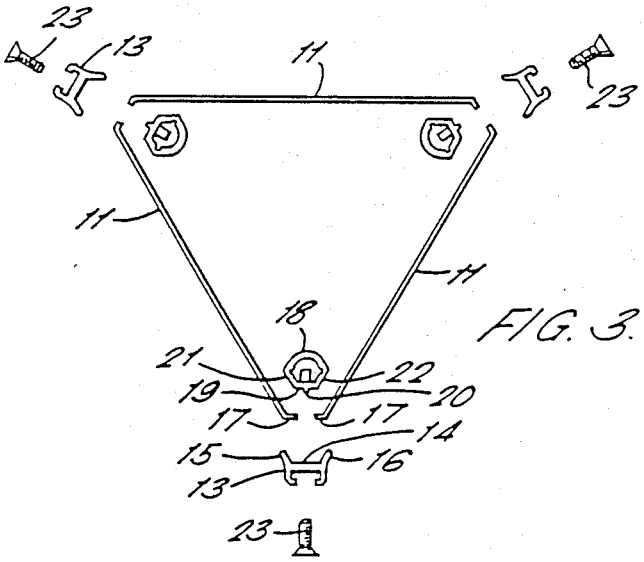
FIG. 3.

ELONGATE HOLLOW STRUCTURAL MEMBERS

This invention relates to elongate hollow structural members and is particularly although not exclusively applicable to structural members for framework in supporting equipment such as lighting or other electrical apparatus, display devices, screens and the like or for supporting canopies, roofing and/or walling.

GB-A No. 943411 discloses a structural member including two or more channel-sectioned members assembled so that the channels are substantially parallel and open toward a common central line to define a passage bounded by the pairs of adjacent flanges of the channel-section members. The channel-section members are secured together by a plurality of clamps spaced apart along the flanges and each engaging a pair of adjacent flanges. The clamps along the respective pair of adjacent flanges are staggered (i.e. no two opposing clamps are of the same lead) so that the clamps can be secured from outside the member. The strength of the structural member thus depends on the strength of the individual channel-section members.

The invention provides a hollow-section elongate structural member comprising a plurality of spaced apart elongate elements extending parallel to one another and a plurality of panels extending between and secured to the elongate members in spaced relation to form the hollow section with each elongate element having a pair of panel edges secured thereto, the panel edges have edge formations to be received by the respective elongate elements and each elongate element having an elongate open channel with a base and side walls, each edge formation of a panel being shaped to conform to a side wall and adjacent part of the base of a channel and a clamping member for each channel formed with a clamping base having a main part flanked by side faces to act in cooperation with the base and side walls of the channel to clamp the edge formation of a pair of panels therein and securing means for securing the clamping members to the channels.

Thus the flanges of the panels in the construction of the present invention are secured to the elongate channel elements throughout the length thereof by means of the clamping members to form a stiff connection between the panel edges throughout the length thereof. The construction thus provides a cohesive struction of the panels, channel elements and clamping members of far greater strength than the panels alone.

Preferably spacer means are provided between the base of the channel and clamping member to maintain a minimum distance between the clamping member and the base of the channel.

In one arrangement the spacer means may comprise an upstanding ridge extending along the length of the clamping member to limit the movement of the clamping member towards the base of the channel and the angled flanges of the panels may engage the base between the ridge and the respective sides of the channel.

The clamping member may be secured in the channel by screws or other releasable fixings extending through the elongate member to secure the clamping member in the channel.

In any of the above arrangements the side walls of the channel of each elongate element may diverge towards the mouth of the channel or may be parallel.

Also in any of the above arrangements each clamping member may be a hollow tubular section and spigots may be mounted in the hollow clamping members at one end of the hollow section to engage in and be secured in the tubular members of an adjacent hollow section for connecting two hollow sections together end to end.

In one arrangement according to the invention the structural member may comprise a pair of panels secured together in spaced face-to-face relationship by a pair of said elongate elements and clamping members to provide a "plank" form structural member.

In a further arrangement the member may comprise three elongate panels secured together by three elongate elements and respective clamping members to form a triangular cross-section structural member.

In a still further arrangement the member may comprise four panels and four elements with the clamping members securing the panels together to provide a quadrilateral (e.g. square or rectangular) form cross-section structural member.

The following is a description of some specific embodiments of the invention, reference being made to the accompanying drawings in which:

FIG. 1 is a side view of a hollow triangular cross-section elongate structural member;

FIG. 2 is an end view of the member shown in FIG. 1;

FIG. 3 is a similar view to that of FIG. 2 with the part shown "exploded";

Figure 7:
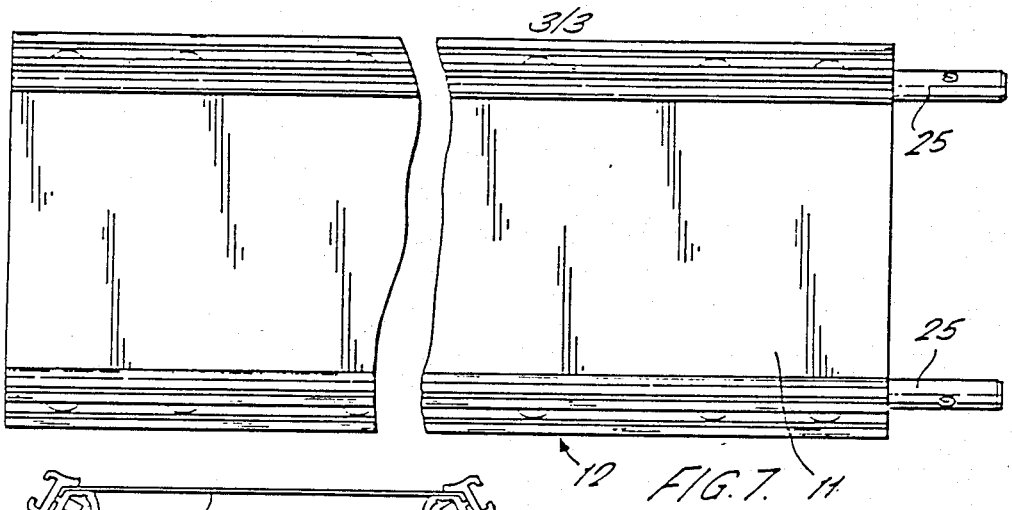
Figure 9:
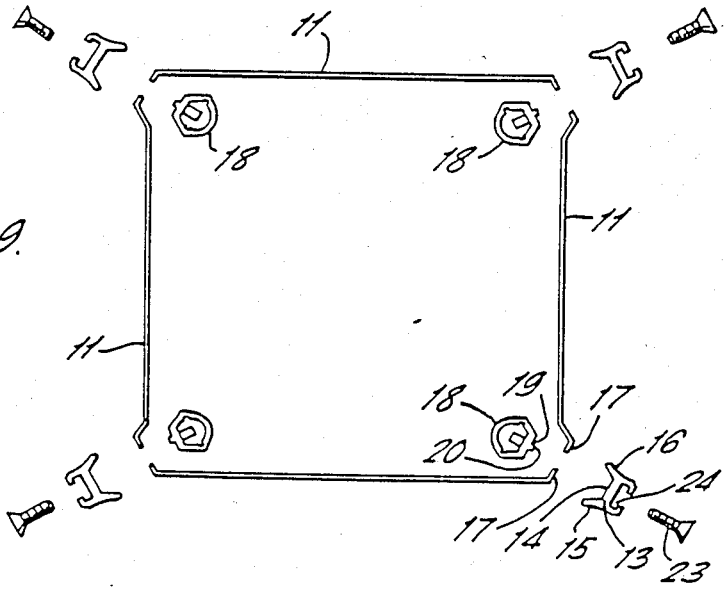

FIGS. 7 or 9 are similar views of a square cross-section structural member.

Referring firstly to FIGS. 1 to 3 of the drawings, there is shown an elongate hollow triangular cross-section structural member indicated generally at 10 comprising three elongate panels 11 arranged in a triangular formation and secured together at the apices of the triangle by elongate fastening members indicated at 12. Each fastening member comprises, on the outer side of an apex of the structure, an extruded channel section 13 providing a base 14 and divergent side walls 15, 16. The divergent side faces 15, 16 of the channel are angled with respect to the base of the channel to receive edge parts of a pair of panels 11 to hold the panels at a corresponding angle. The panels 11 have angled flanges 17 along their respective edges and the flanges engage the base of the channel 14 adjacent the side faces 15, 16.

The edge parts of the panels are secured in the channel by means of an elongate hollow extruded clamping member 18 having a clamping face 19 to engage the flanges 17 of the panel with a raised ridge 20 extending along the centre of the clamping face to engage between the flanges 17 to space the flanges 17 apart and engage the base of the channel 14 to limit the pressure which can be applied by the clamping member to the flanges. The clamping face 19 is flanked by divergent side faces 21, 22 respectively to engage the edge parts of the panels 11 and hold them in contact with the divergent sides 15, 16 of the channel. The clamping member 18 is secured to the channel by means of a plurality of set screws 23 extending through holes in the base of the channel, between the flanges 17 and into screw threaded holes in the clamping member 18. The clamping member is tightened against the edge parts of the panels 11 to lock them securely in the channel 14 and engagement of the wedge 20 on the clamping face of the clamping member against the base 14 of the channel limits the stress which can be applied to the panels by the clamping member which might otherwise cause distortion of the panels. The edge of the panels 11 may have segment shaped cut-outs at spaced locations along the edges to accommodate the screws 23 and to provide positive location of the panels in the lengthwise direction of the channel.

The member 13 has a further undercut channel 24 on the opposite side to channel 14 for attachment of fittings to the member by means of standard insert and locking devices.

Similar fastening members are provided at each of the other two apices of the triangular structure to secure the panels together in a rigid hollow triangular section structure. Other tubular members have solid spigots 25 located in the ends thereof at one of the structural member to project from the tubular members and engage in corresponding tubular members of a further structural member for securing two structural members together end to end. The spigots can also be used for fastening the structural member to pre-formed corner or other bridging pieces. The structural members can be erected to provide a frame for a wide variety of uses including set lighting, advertisement hoardings, display panelling, film or video screens and the like. The structure can also be utilised to support screening, canopies or the like for internal or external use.

Figure 4:
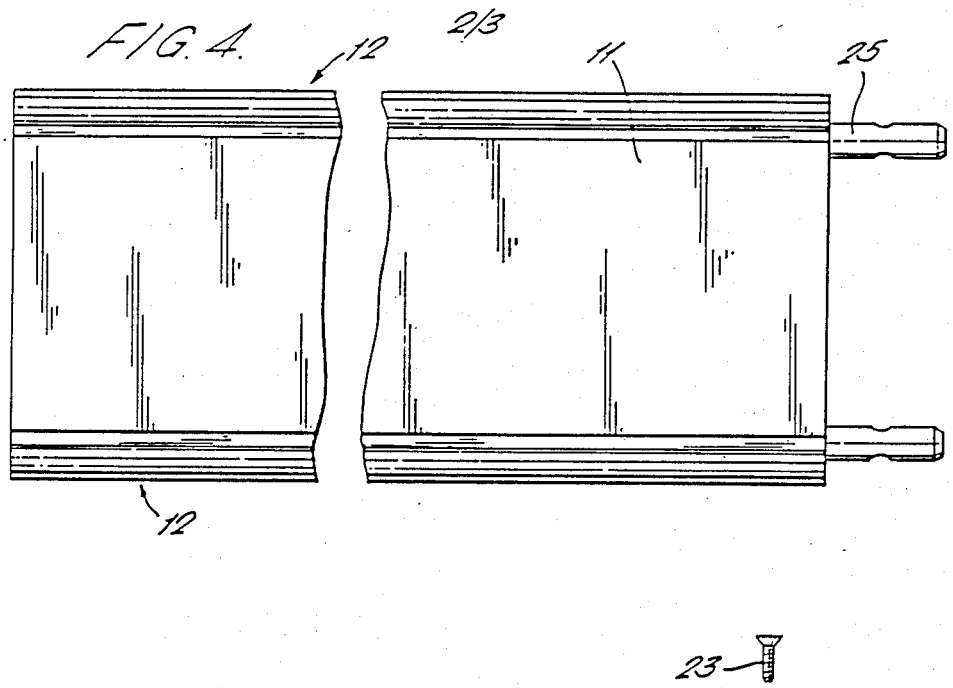
FIGS. 4 to 6 are simlar views of a "panel" form structural member.
Figure 5:
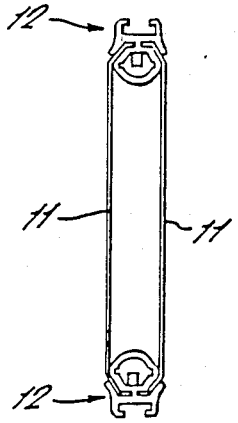
Figure 6:
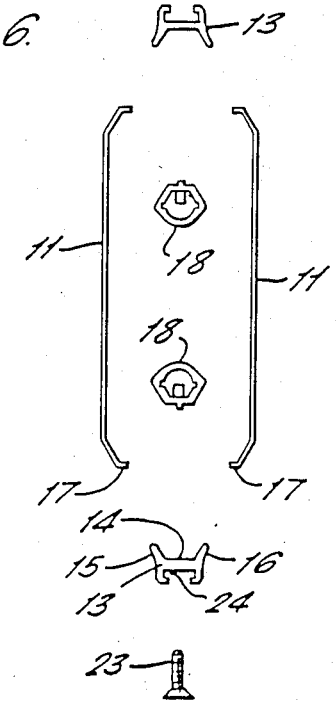
Figure 8:
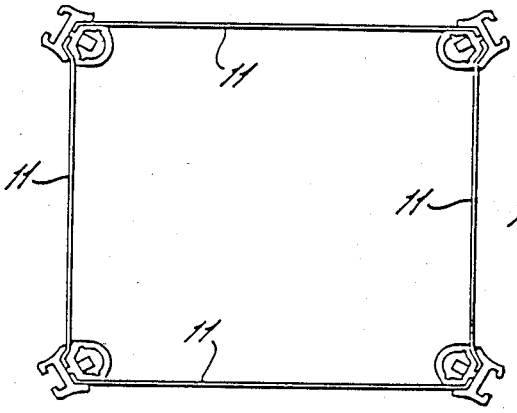

FIGS. 4 to 6 show a variation of the structure shown in FIGS. 1 to 3 in which a pair of panels are connected together by a pair of fastening devices to form a plank-like member. A further variation is shown in FIGS. 7 to 9 in which four panels are connected by four fastening members to create a square (or quadrilateral) or box section hollow structural member.

It will be appreciated that the simple form of connection between the panels and the fastening members enables a wide variety of structural forms to be created to suit particular needs. Since the structural members can be readily assembled, they can be transported packed flat and assembled on site to minimise the space required in transport.

We claim:

1. A hollow-section elongate structural member comprising a plurality of spaced apart elongate elements extending parallel to one another and a plurality of panels extending between and secured to the elongate members in spaced relation to form the hollow section with each elongate element having a pair of panel edges secured thereto, the panel edges have edge formations to be received by the respective elongate elements and each elongate element having an elongate open channel with a base and side walls, each edge formation of a panel being shaped to conform to a side wall and adjacent part of the base of a channel and clamping means for each channel for clamping the edge formations of a pair of panels in the channel; characterised in that the clamping means comprise a clamping member formed with a clamping facing having a main part flanked by side faces to act in cooperation with the base and side walls of the channel to clamp the edge formation of a pair of panels therein and securing means for securing the clamping members to the respective channels; and in that spacer means are provided between the base of the channel and clamping member to maintain a minimum distance between the clamping member and the base of the channel.

2. A structural member as claimed in claim 1, characterised in that the spacer means comprises an upstanding ridge extending along the length of the clamping member to limit the movement of the clamping member towards the base of the channel and the angled flanges of the panels engage the base between the ridge and the respective sides of the channel.

3. A structural member as claimed in claim 1, characterised in that the clamping member is releasably fixed to the elongate member to secure the clamping member in the channel.

4. A structural member as claimed in claim 1, characterised in that the side walls of the channel of each elongate element diverge towards the mouth of the channel or are parallel.

5. A structural member as claimed in claim 1, characterised in that each clamping member is a hollow tubular section and spigots are mounted in the hollow clamping members at one end of the hollow section to engage in and be secured in the tubular members of an adjacent hollow section for connecting two hollow sections together end to end.

6. A structural member as claimed in claim 1, characterised in that the structural member comprises a pair of panels secured together in spaced face-to-face relationship by a pair of said elongate elements and clamping members.

7. A structural member as claimed in claim 1, characterised in that the member comprises three elongate panels secured together by three elongate elements and respective clamping members to form a triangular cross-section member.

8. A structural member as claimed in claim 1, characterised in that the member comprises four panels and four elements and clamping members securing the panels together in a square or quadrilateral cross-section formation.

* * * * *